United States Patent [19]

Speranzin

[11] 4,040,241

[45] Aug. 9, 1977

[54] DEVICE FOR DISTRIBUTING SOFTENING LIQUID ON THE YARN DURING THE TWISTING PROCESS

[75] Inventor: Claudio Speranzin, Pordenone, Italy

[73] Assignee: Officine Savio, S.p.A., Udine, Italy

[21] Appl. No.: 640,155

[22] Filed: Dec. 12, 1975

[30] Foreign Application Priority Data

Dec. 12, 1974 Italy ..... 83450/74

[51] Int. Cl.[2] ..... D01H 13/30; D01H 7/86

[52] U.S. Cl. ..... 57/35

[58] Field of Search ..... 57/34 R, 35, 58.49, 57/58.7, 58.83, 106, 108, 164

[56] References Cited

U.S. PATENT DOCUMENTS

| | | | |
|---|---|---|---|
| 3,159,962 | 12/1964 | Franzen | 57/35 X |
| 3,295,305 | 1/1967 | Nimtz | 57/58.49 |
| 3,295,306 | 1/1967 | Rehn | 57/164 X |
| 3,429,113 | 2/1969 | Nimtz et al. | 57/35 X |
| 3,563,019 | 2/1971 | Greive et al. | 57/164 X |
| 3,638,415 | 2/1972 | Andrews | 57/164 X |

*Primary Examiner*—Donald Watkins

*Attorney, Agent, or Firm*—Stevens, Davis, Miller & Mosher

[57] ABSTRACT

A device for distributing softening liquid to a yarn, when the yarn is being balloon twisted and has emerged from the spindle or core of the spindle including a container for the balloon, at least one chamber integrally fixed to an external portion of the container wherein the balloon slides, at least one feeding means for supplying liquid to said chamber and at least one porous seepage septum, which is present as an inner sliding surface for the balloon. The chamber is fed with liquid under adjustable pressure.

15 Claims, 6 Drawing Figures

DEVICE FOR DISTRIBUTING SOFTENING LIQUID ON THE YARN DURING THE TWISTING PROCESS

The present invention relates to a device for distributing softening liquid on the yarn during the twisting process. More particularly, the invention relates to a device suitable for ensuring constant dampening of the yarn on a double-twist twisting frame. The softening liquid is distributed mainly on the yarn during twisting so as to permit a higher speed without dust and with an equal quality in the product treated.

Present techniques arrange for special devices to replace the early systems which immersed the yarn. The devices consist substantially of an element containing the liquid to impregnate the yarn. The element is disposed near the balloon which forms during the twisting process. The container element is equipped with means to spread the liquid over a surface on which the balloon itself slides.

An obvious disadvantage of such a system is that the softening liquid is caused to seep through onto the surface whter the balloon slides. It is not taken up by the yarn and drops onto the twisting frame, thus forming together with the dust unwanted deposits, which means damage to the functioning of the machines without taking into account the considerable consequent waste of liquid.

Therefore one object of the present invention is to arrange for means to collect excess liquid and thus to avoid the aforesaid disadvantage.

A further object is the realization of direct inflow of the liquid onto the surface whereon the balloon slides, thus avoiding the use of containers drip-feeding the liquid near the area where the balloon is formed.

A further object is the ability to supply the softening liquid in a desired quantity continuously to the yarn along the entire quantity of the yarn itself.

In fact it is an advantage to be able to avoid having deposits caused by excess softening liquid on the machines, thus preventing consequent waste and damaging deposits.

A further advantage is the fact that the softening is homogeneous since the liquid is not allowed to remain for a certain period in a collection means.

Still yet another advantage is to be able to supply softening liquid continuously and to apply the softening process to the whole yarn.

Also it is an advantage to be able to regulate the amount of softening liquid supplied to the yarn.

A still further advantage is to maintain all of the foregoing benefits when twisting is carried out both in the form os S and Z.

The objects and the consequent advantages together with further objects and advantages are obtained with a device for distributing softening liquid on the yarn during the process of twisting said yarn, as soon as the yarn has emerged from the spindle or core of the spindle, while the balloon in the process of formation is sliding on the inner sliding surface of the container. The device is characterized by including in reciprocal combination and cooperation at least one means for feeding liquid, the means having a chamber integrally fixed to an external portion of the surface whereon the balloon slides and communicating with the inner sliding surface by means of at least one porous seepage septum, which is present in said sliding surface for the balloon and itself constitutes a portion of the inner sliding surface. There also may be a chamber element to collect the excess liquid. This element is positioned below the feeding means and corresponds with a small collection window present in the container of the balloon and below the coordinated set of holes. The chambered means for feeding liquid is supplied with liquid by means of adjustable pressure. There also could be means linked to the yarn being twisted, thereby permitting the passage of liquid or otherwise.

The invention will now be better described by making reference to the accompanying drawing, which has been supplied for non-limitative, exemplificative purposes and represents a preferred solution, in which.

In the figures the same parts or parts performing the same functions are referenced with the same numbers.

Figure 1:
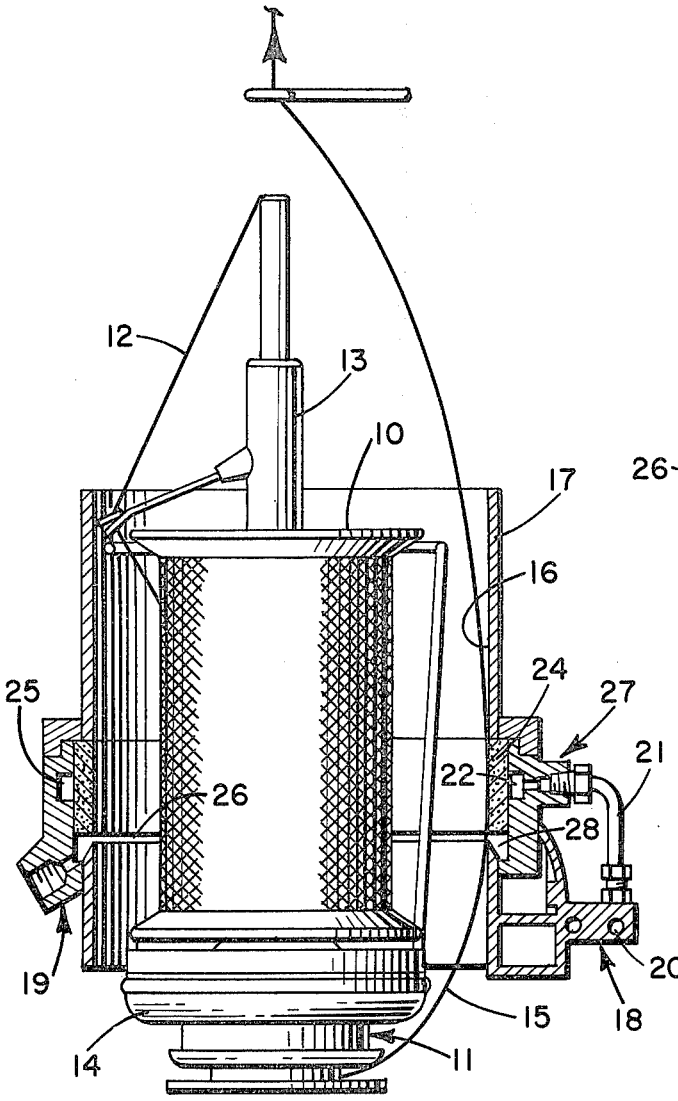
FIG. 1 shows the bobbin being fed in a double-twist twisting frame equipped with a device in accordance with the invention.

With reference to FIG. 1, bobbin 10 is fed and positioned on the head of the twisting frame 11. Yarn 12 is drawn off the bobbin 10 and caused to pass through the core of spindle 13. yarn 12 is then caused to go upwards outside the bobbin 10 and is twisted by the rotation of the yarn-guiding rotating plate 14. All of these steps are carried out in a known manner. Under these conditions the balloon 15 forms and slides on the inner surface 16 of the container 17 of the balloon.

Figure 2:
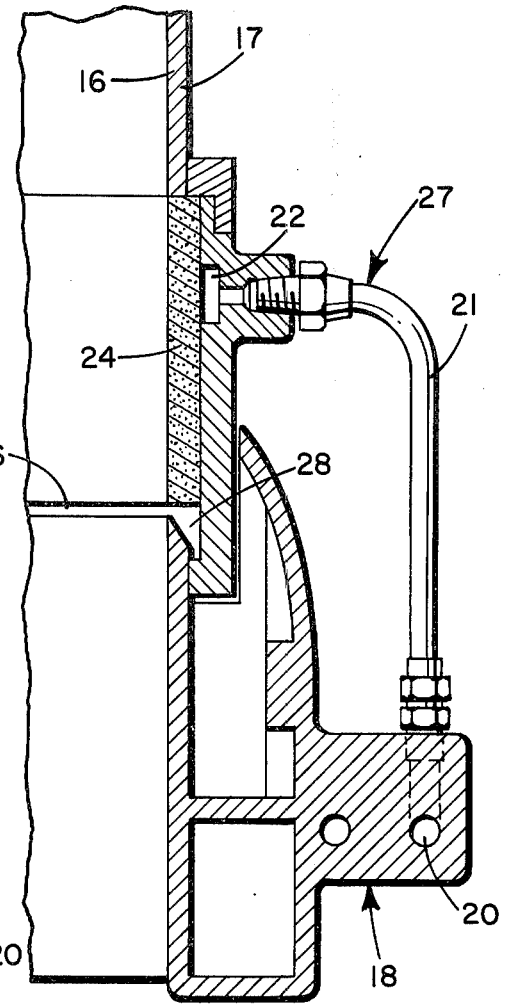
FIG. 2 shows the device in accordance with the invention illustrated in FIG. 1 but on a larger scale.
Figure 3:
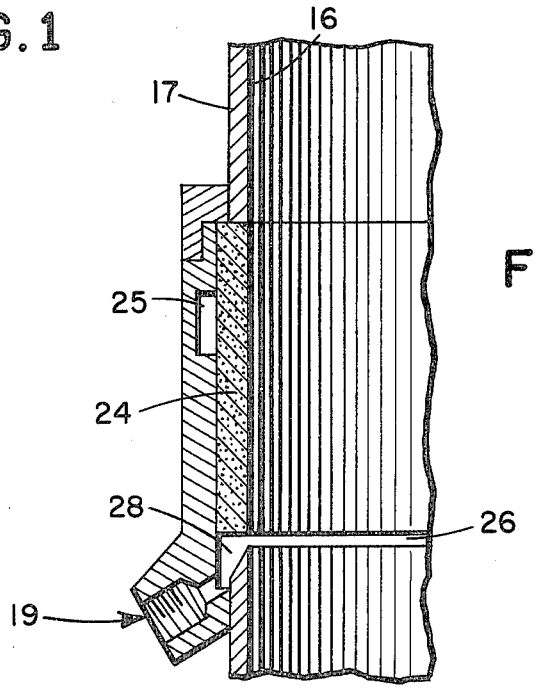
FIG. 3 shows another detail of the device of FIG. 2.

This sliding takes place on an area of the inner surface 16 of the container 17 of the balloon which is substantially intermediate and in correspondence with the device better shown in FIG. 2 and the following FIGS. which is mounted externally.

The device consists substantially of two parts, of which the first 18 is for the receipt and supply of liquid under pressure, while the second 19 serves to collect any excess liquid.

The liquid under pressure is brought to the device, generically indicated by 27, through the conduit 20 and passes therefrom through a connecting pipe 21 into a small chamber 22 next to the outer surface of the container 17 of the balloon. The connecting pipe 21 is arranged to be equipped with a device FIG. 4 for controlling the flow. The device 23 may be a tap or any system for regulating the pressure.

In the example shown the connecting pipe 21 within said small chamber 22 communicates with a conduit 25 bounded on one side by the porous septum 24. Besides occupying part of the chamber 22 the porous septum also is associated with the container 17 of the balloon in such a way as to constitute a portion of the inner surface 16. The porous septum 24 may be associated with the whole inner annular surface of 16 or with only a part thereof.

If the liquid which seeps from the porous septum 24 is not taken up by the balloon 15 of the yarn 12, it descends along the inner surface 16 until it reaches a small collection window 26.

During the course of its movement the balloon 15 slides on the vertical portion of the inner surface 16 which is impregnated by the porous septum 24. Thus the balloon is impregnated with liquid in a homogeneous manner and in this way obtains the desired characteristics.

From this it appears that only the excess liquid is collected by the collecton window 26. When the delivery pressure of the liquid has been well adjusted for the density of the liquid to be delivered, for the setting of the porous septum 24 and for the speed of the yarn 12, the excess of liquid can be eliminated. The window 26 communicates with the second portion 19 of the device, this portion consisting of a conveying channel 28 through which the liquid, suitably filtered, may be recirculated. So as to obtain a more homogeneous distribution of the softening liquid, the porous septum 24 may be disposed in an annular manner in the inner surface 16, or else more than one row or more than one circular sector may be disposed in series or in parallel.

When there is more than one porous septum 24, the septa may all be connected up for working or may be connected up individually as desired, depending on the yarn to be treated, on its twisting speed as well as on other factors.

Therefore the porous septum 24 may be connected independently from the others to the main supply channel 20 through a chamber 22, and every connecting conduit 21 may have independent regulating and cut-out means 23.

Figure 4:
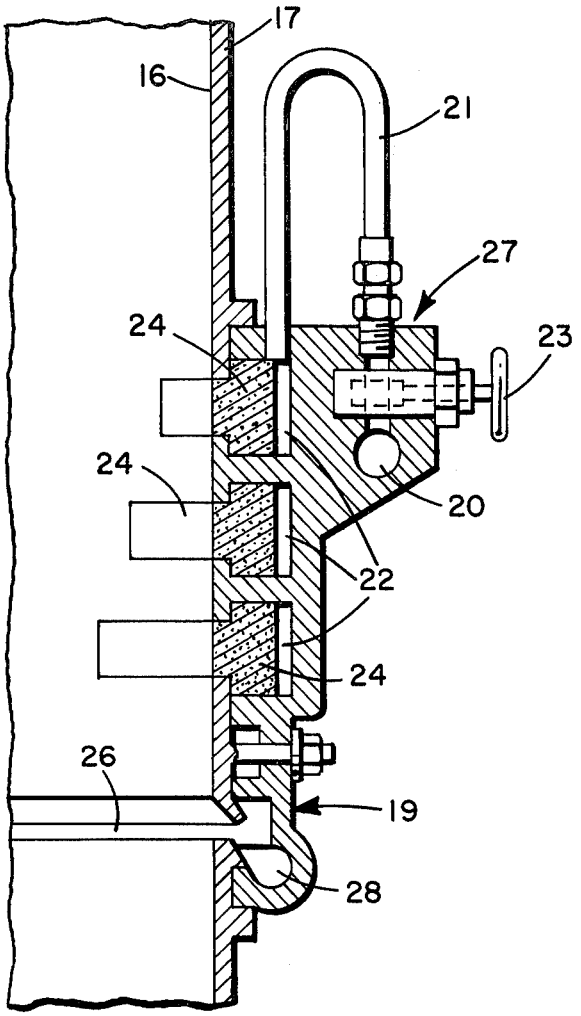
FIG. 4 shows a further embodiment.
Figure 5:
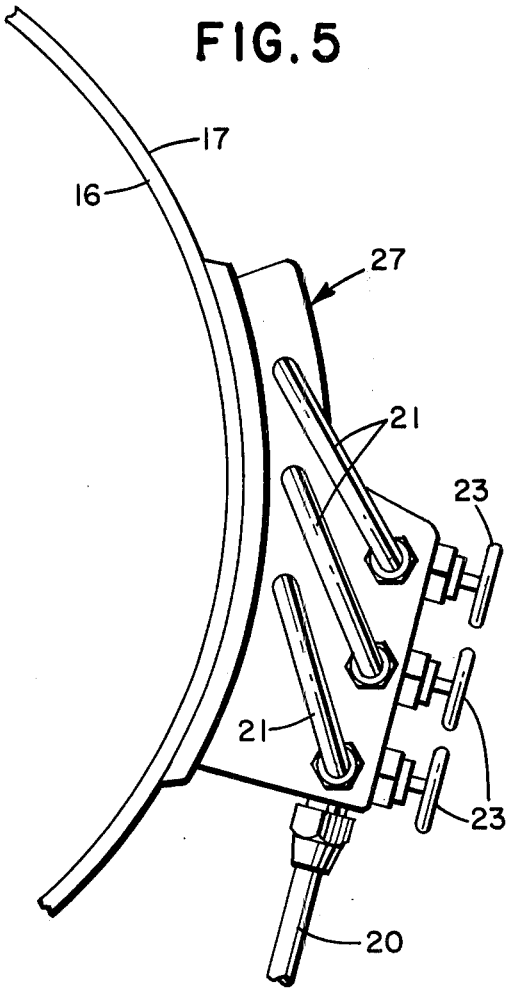
FIG. 5 shows a plan view of the device of FIG. 4 from above.

Thus in the example of FIGS. 4 and 5 three porous septa 24 have been provided for, and these are associated with sectors of the inner ring of the surface 16. The porous septa 24 can be connected up or cut out by means of taps 23.

Figure 6:
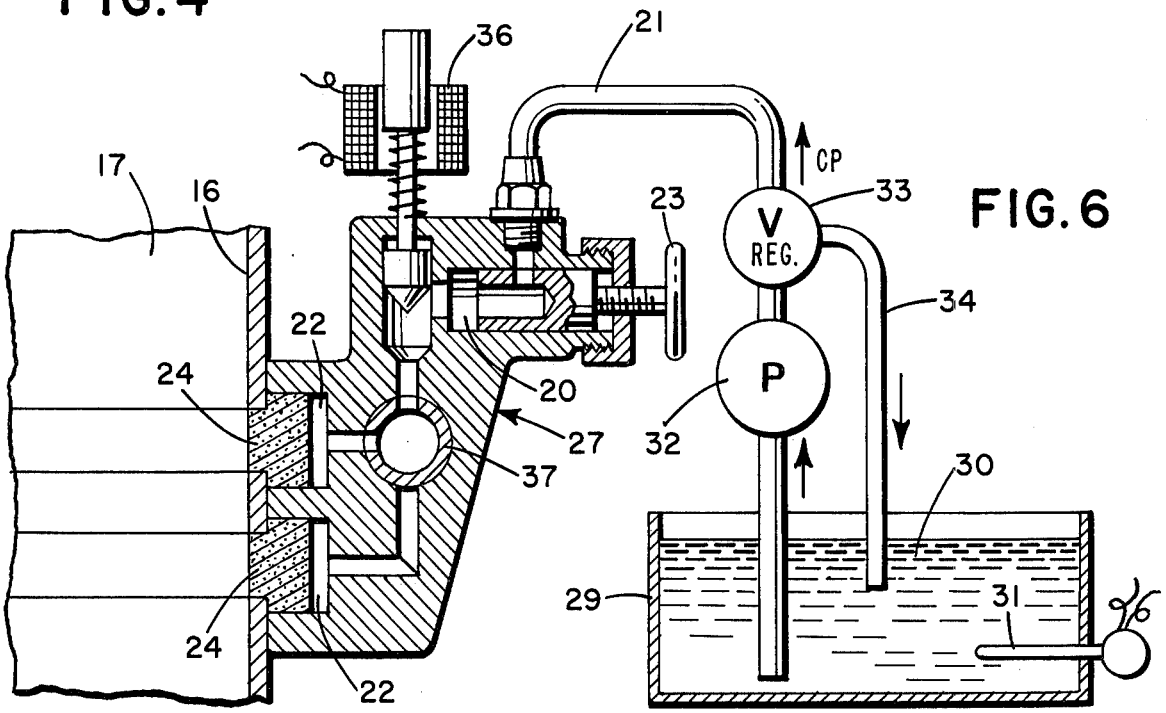
FIG. 6 shows another embodiment connected to a typical delivery plant.

In FIG. 6 is shown a variant from the invention, and this variant does not provide for the part 19 for collection of excess liquid. In accordance with this solution the device is provided with valve means which are conditioned by the yarn 12 being twisted. In fact experiments show that a seepage of softening liquid takes place when the yarn 12 breaks or ends, namely when the balloon 15 does not brush against the inner surface 16 and take away the softening liquid.

In accordance wih the solution of FIG. 6 the device 27 is foreseen to include a feed pipe 20 connected to a tank 29, which contains softening liquid 30 kept at a given temperature by thermostat means 31, a pump 32 through which the liquid passes, which may have downstream from itself a pressure regulator 33 with a discharge conduit 34; a regulating or shut-off tap 23, a valve 35, controlled mechanically or pneumatically or electrically, for example through a solenoid 36, actuated by the presence of the yarn 12 being twisted; a distribution tap 37, which may put one or more chambers 22 into communication with the delivery conduit 20, and one or more sets of porous septa 24 for each chamber 22. By means of the device of FIG. 6 the wastage of softening liquid which takes place when the yarn 12 is not being processed is avoided.

To control the valve 35 mechanically it is possible to use either a feeler means or a bobbin-lifter or both, connection being made by means of kinematic motions of a known type.

To control the valve pneumatically or electrically it is possible to use either a feeler means of the bobbin-lifter or another device connected to the yarn 12.

It also is obvious to an expert in this field how it is possible to apply numerous modifications to the invention without thereby departing from the field of the invention.

Thus it is possible to alter the shape and sizes of the device; the container of the balloon could be arranged to be suitable for the installation of more than one delivery device; the system for regulating the pressure and flow could be varied as also could the shape of the connecting pipe, and so on without thereby departing from the scope of the inventive idea.

I claim:

1. A device for distributing softening liquid to a yarn, when the yarn is being balloon twisted and has emerged from a spindle or core of the spindle including a container for the balloon, at least one chamber integrally fixed to an external portion of the container wherein the balloon slides, at least one feeding means for supplying liquid to said chamber and at least one porous seepage septum which is present as an inner sliding surface for the balloon, said chamber being feedable with liquid under adjustable pressure.

2. The device according to claim 1, including a delivery conduit and means positioned upstream of said chamber which regulate and condition the flow of liquid.

3. The device according to claim 1, wherein the porous septum is positioned within said chamber.

4. The device according to claim 2, wherein said regulating means includes a distribution tap between said chamber and said delivery conduit.

5. The device according to claim 4, wherein said regulating means includes a valve positioned between said delivery conduit and said distribution tap which is controlled by the yarn being twisted.

6. The device according to claim 5, wherein said valve is operated mechanically be means of levers.

7. The device according to claim 5, wherein said valve is operated pneumatically.

8. The device according to claim 5, wherein said valve is operated electically.

9. The device according to claim 5, including feeler means and/or a bobbin-lifter to operate said valve.

10. The device according to claim 1, including a delivery conduit in communication with said feeding means, pump, tank and thermostat, which delivery conduit is fed continuously under constant adjustable pressure by said pump drawing liquid from said tank, which holds softening liquid at a constant adjustable temperature.

11. The device according to claim 1, including a conveying channel and a collection window in said container, said conveying channel and collection window being positioned between said porous seepage septum for collecting excess liquid.

12. The device according to claim 11, wherein said collection window extends by a substantially equal and symmetrical portion below the porous seepage septum.

13. The device according to claim 11, including a tank wherein said conveying channel is connected to said tank containing softening liquid.

14. The device according to claim 1, wherein the porous septum is associated in an annular manner with the whole inner surface of the container.

15. The device according to claim 1, wherein there is a pluraltiy of porous septa.

* * * * *